United States Patent [19]

Adin

[11] 3,957,514

[45] May 18, 1976

[54] PHOTOGRAPHIC ELEMENT CONTAINING A PHOTOREDUCIBLE SALT OF AN ARYL HYDROXY-CARBOXY ANION AND A TETRAZOLIUM CATION AND THE USE THEREOF

[75] Inventor: Anthony Adin, Rochester, N.Y.

[73] Assignee: Eastman Kodak Company, Rochester, N.Y.

[22] Filed: Sept. 26, 1974

[21] Appl. No.: 509,615

[52] U.S. Cl. ..... 96/48 R; 96/48 QP; 96/76 R; 96/90 R; 260/308 D

[51] Int. Cl.[2] ..... G03C 5/24; G03C 1/52

[58] Field of Search ..... 96/90 R, 48 R, 48 QP, 96/76 R; 260/308 D

[56] References Cited

UNITED STATES PATENTS 2,713,581 7/1955 Pannone et al. ..... 260/308

2,915,392 12/1959 Pedersen ..... 96/90 R

FOREIGN PATENTS OR APPLICATIONS 670,883 4/1952 United Kingdom ..... 96/90

*Primary Examiner*—Won H. Louie, Jr.
*Attorney, Agent, or Firm*—D. M. Schmidt

[57] ABSTRACT

An imaging element and process wherein a tetrazolium cation, which is present in combination with a reducing anion as a salt, is imagewise exposed and reduced by the anion to form a formazan dye, without the need for a separate photoreductant. Stabilization of the resulting dye and fixing of the element can be achieved by the introduction into the element of a salt of a metal.

14 Claims, No Drawings

PHOTOGRAPHIC ELEMENT CONTAINING A PHOTOREDUCIBLE SALT OF AN ARYL HYDROXY-CARBOXY ANION AND A TETRAZOLIUM CATION AND THE USE THEREOF

BACKGROUND OF THE INVENTION

1. Field of the Invention

This invention relates to an imaging element and process which rely upon the photoinitiated reduction of a tetrazolium salt to form a formazan dye. For stabilized images, a subsequent or simultaneous chelation is preferred utilizing a metal ion.

2. State of the Prior Art.

Tetrazolium salts are a common source of imaging dyes, and in many instances are converted through the action of a reducing agent of some kind. British Pat. No. 670,833 is representative of patents which disclose the photoreduction of such salts. In one exemplary form the imagewise radiation of ferric ammonium salts of citric acid converts Fe(III) to Fe(II), and Fe(II) thereafter reduces the tetrazolium salt to the formazan dye. An organic hydroxy acid or its ammonium salt is disclosed as being useful in removing the undesirable brown oxide that results from this process.

Other patents disclosing photoreduction of tetrazolium salts by the use of other reducing agents are U.S. Pat. No. 3,655,383 and British Pat. No. 954,198.

To overcome the tendency to fade which characterizes such formazan dyes, metal compounds have been added to chelate the dye and to thereby color-shift it. Typical metals include metals such as cobalt, iron, nickel, etc., and typically they are added in the form of acid salts such as nitrates, and in the form of organic complexes. Examples are disclosed in U.S. Pat. No. 3,503,741 and Brit. Pat. 1,016,822.

Yet another use of the photoreduction of tetrazolium salts is disclosed in commonly assigned applications U.S. Ser. Nos. 384,858; 384,859; and 384,861; filed on Aug. 2, 1973; by D. Bailey, R. Brongo et al, and J. Fleming et al, respectively, entitled "Photographic Elements and Processes for Producing Formazan Dye Images of Enhanced Stability", "Tetrazolium Salt Photoreductive Imaging", and "Photographic Elements and Processes For Incorporated Hydrogen Source Photoreduction Imaging", respectively. Ser. No. 384,861 concerns the reduction of certain imaging means, such as tetrazolium salts, by a specific novel class of photoreductants, namely those which incorporate an internal hydrogen source. Ser. No. 384,859 is directed to the combination of tetrazolium salts and photoreductants broadly, while Ser. No. 384,858 concerns an improved class of tetrazolium salts in combination with photoreductants. Ser. No. 384,858 issued as U.S. Pat. No. 3,887,372, Ser. No. 384,859 issued as U.S. Pat. No. 3,887,374, and Ser. No. 384,861 has been refiled as U.S. Ser. No. 509,616 on Sept. 26, 1974.

Although each of these prior systems provide useful visible imaging means, they are characterized by the requirement that a substance additional to the tetrazolium salt must be added as a photoactivator. Although British Pat. No. 1,016,822, published Jan. 12, 1966, and Schiele U.S. Pat. No. 3,278,366, issued Oct. 11, 1966, teach the self-initiated reduction of a tetrazolium salt to a formazan dye, the salts involved do so only in response to radiation of 200 nm or less. It will be readily appreciated that an element which incorporates a tetrazolium salt that is itself sensitive to radiation wavelengths greater than 200 nm will be a distinct improvement.

An undesired side result of such prior systems is that blue formazan dyes, if formed, often are derived from, and therefore leave in the background areas, tetrazolium salts having an undesirable yellow color. Blue formazan dyes imagewise formed so as to leave clear background areas would represent a further improvement.

Patents pertinent only to the background of the use of certain acids as photoreductants are U.S. Pat. Nos. 2,915,392 and 3,642,478. Patents directed to methods of making certain tetrazolcarboxylic acid salts include French Pat. No. 1,099,845.

OBJECTS OF THE INVENTION

It is an object of the invention to provide an imaging element and process incorporating a tetrazolium salt which is itself imagewise responsive to radiation of a wavelength equal to or greater than 300 nm.

It is a related object of the invention to provide such an element and process without requiring the addition of still other photoreductants.

A further object of the invention is to provide such an element and process which can be stabilized against dye fade and fixed against background print-out.

Yet another object of the invention is to provide such an element and process wherein the background of the blue formazan dye image is essentially colorless.

Other objects and advantages will become apparent upon reference to the following Summary of the Invention and Discussion of the Preferred Embodiments.

SUMMARY OF THE INVENTION

The invention concerns an imaging element and process based upon tetrazolium salts which are themselves photosensitive. More specifically, there is provided a photosensitive element comprising (A) a support, and (B) at least one layer coated over the support comprised of a salt of a tetrazolium cation and an anion capable of reducing said cation to a formazan dye upon exposure to activating radiation.

The method of imaging comprises imagewise exposing an element including a support and at least one layer coated over the support comprised of a salt of a tetrazolium cation and an anion capable of reducing said cation to a formazan dye, and chelating said dye to stabilize it.

DESCRIPTION OF THE PREFERRED EMBODIMENTS

The invention concerns an imaging element and process based upon the discovery that certain tetrazolium salts have the unique property of being themselves photosensitive. Specifically, it has been discovered that aromatic hydroxy-carboxy anions when combined with tetrazolium cations are photosensitive without the aid of other photoreductants. By "photosensitive" as used in this application, it is meant that the salt will undergo a reduction in response to radiation having a wavelength equal to or greater than about 300 nm.

A particularly useful anion is that having the formula:

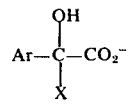

wherein Ar is an aromatic radical containing from 6 to 10 carbon atoms, such as phenyl or naphthyl radical, which can be unsubstituted or include substituents such as an alkyl having 1 to 10 carbon atoms, a halogen, a cyano and a nitro; and X is either an aromatic group such as Ar or is hydrogen. A particularly useful class of anions includes mandelate and benzilate anions.

The tetrazolium cation can take any form found in conventional tetrazolium salts. A wide variety of such tetrazolium cations are known to the art, including bis-tetrazolium cations linked directly or through intervening divalent radicals in the 2 or 5 positions. As is well understood by those skilled in the art, tetrazolium salts require for preparation the presence of aromatic (e.g., phenyl, naphthyl, anthryl, pyridyl, oxazolyl, thiazolyl, quinolinyl, benzoxazolyl, benzothiazolyl, etc.) substituents in the 2 and 3 positions of the tetrazole nucleus. The 5 position substituent to the tetrazole nucleus can be an aromatic group selected from the same general class as the 2 and 3 position substituents or can be hydrogen or an aliphatic substituent, such as an alkyl group having from 1 to 20 carbon atoms. Representative dye forming tetrazolium cations are as follows:

TABLE I

| Exemplary Dye Forming Tetrazolium Cations | |
|---|---|
| T - 1 | 2,3,5-triphenyl-2H-tetrazolium |
| T - 2 | 2-(2-methylphenyl)-3,5-diphenyl-2H-tetrazolium |
| T - 3 | 2-(4-chlorophenyl)-3,5-diphenyl-2H-tetrazolium |
| T - 4 | 2,3-diphenyl-5-(4-chlorophenyl)-2H-tetrazolium |
| T - 5 | 2-(4-iodophenyl)-3,5-diphenyl-2H-tetrazolium |
| T - 6 | 2-(4-chlorophenyl)-3-(2-chlorophenyl)-5-(2-pyridyl)-2H-tetrazolium |
| T - 7 | 2,3-diphenyl-2H-tetrazolium |
| T - 8 | 2-(2-methoxyphenyl)-3,5-diphenyl-2H-tetrazolium |
| T - 9 | 2,3-diphenyl-5-methyl-2H-tetrazolium |
| T - 10 | 2,3-diphenyl-5-dodecyl-2H-tetrazolium |
| T - 11 | 5-(3-iodophenyl)-2,3-diphenyl-2H-tetrazolium |
| T - 12 | 5-cyano-2,3-diphenyl-2H-tetrazolium |
| T - 13 | 5-acetyl-2,3-diphenyl-2H-tetrazolium |
| T - 14 | 2,5-diphenyl-3-(4-tolyl)-2H-tetrazolium |
| T - 15 | 2,5-diphenyl-3-(4-biphenylyl)-2H-tetrazolium |
| T - 16 | 2,3-diphenyl-5-(2-chlorophenyl)-2H-tetrazolium |
| T - 17 | 5-(3,4-dimethoxyphenyl)-3-(4-nitrophenyl)-2-phenyl-2H-tetrazolium |
| T - 18 | 2,3-diphenyl-5-nitro-2H-tetrazolium |
| T - 19 | 2,3-diphenyl-5-(2-naphthyl)-2H-tetrazolium |
| T - 20 | ethylenebis[5-(2,3-diphenyl-2H-tetrazolium] |
| T - 21 | 1,6-hexylenebis[5-(2,3-diphenyl-2H-tetrazolium] |
| T - 22 | 1,4-phenylenebis[5-(2,3-diphenyl-2H-tetrazolium] |
| T - 23 | 4,4'-biphenylylenebis[2-(5-methyl-3-phenyl-2H-tetrazolium] |
| T - 24 | 4,4'-phenylene sulfoxide-bis[2-(3,5-diphenyl-2H-tetrazolium] |
| T - 25 | 4,4'-biphenylylenebis[2-(3-diphenyl-5-(3,4-methylenedioxyphenyl-2H-tetrazolium] |
| T - 26 | 2-phenyl-3-(4-nitrophenyl)-5-undecyl-2H-tetrazolium |
| T - 27 | 2,3-diphenyl-5-carbethoxy-2H-tetrazolium |
| T - 28 | 5-carbohexoxy-2,3-diphenyl-2H-tetrazolium |
| T - 29 | 5-acetyl-2-phenyl-3-(4-chlorophenyl)-2H-tetrazolium |
| T - 30 | 2,3-diphenyl-5-(1-naphthyl)-2H-tetrazolium |
| T - 31 | 2-(2,4,6-trichlorophenyl)-3,5-diphenyl-2H-tetrazolium |
| T - 32 | 2-(3,4-dichlorophenyl)-3,5-diphenyl-2H-tetrazolium |
| T - 33 | 2,3-diphenyl-5-(3-nitrophenyl)-2H-tetrazolium |
| T - 34 | 2-(3-nitrophenyl)-3,5-diphenyl-2H-tetrazolium |
| T - 35 | 2,3-diphenyl-5-(4-nitrophenyl)-2H-tetrazolium |

In commonly assigned U.S. Pat. application Ser. No. 384,858, cited above, there is disclosed tetrazolium cations which produce formazan dyes exhibiting high image densities and having a low susceptibility to fading. Particularly, the cations most effective are those having substituents on the tetrazole nucleus which are, collectively, predominantly electronegative (i.e., electron withdrawing). These also may be used in this invention. Particularly stable tetrazolium cations are those having tetrazole nucleus substituents the algebraic sum of whose Hammett sigma values is collectively greater than 0.78 and, preferably, greater than 1.00. If one or more of the substituent rings is in turn substituted at only one ring position adjacent to the ring-to-nucleus bonding position--i.e., the ring position (or positions) ortho to the bonding position, the algebraic sum of the sigma values for all tetrazole nucleus substituents need only be greater than 0.40 and, preferably, 0.50 in order to achieve the advantages of significantly improved image densities and dye stabilities. When two such ortho position electronegative substituents are present in a single substituent ring, however, they are essentially subtractive in effect. For example, two like ortho substituents on a 2, 3, or 5 position phenyl ring of a tetrazolium salt are substantially self-cancelling in effect. A comparable tetrazolium salt having only one ortho substituent and having summed Hammett sigma values for all substituents of 0.40 or greater exhibits marked stability. If a 2,3-diphenyl or 2,3,5-triphenyl-2H-tetrazolium salt has no ortho substituents (or cancelling ortho substituents), but has meta and/or para substituents so that the summed sigma values for the phenyl rings are greater than 0.78, then the salt exhibits a marked improvement in its stability.

The tetrazolium cations used in the preferred practice of this invention can be comprised of any desired combination of 2, 3 and, optionally, 5 position aromatic rings such as phenyl, naphthyl, anthryl, quinolinyl, pyridyl, azolyl, and the like. Typical azolyl rings include oxazolyl, thiazolyl, benzoxazolyl, benzothiazolyl and the like. These rings can in turn carry substituents. Exemplary of specifically contemplated ring substituents are lower alkyl (i.e., one to six carbon atoms), lower alkenyl (i.e., two to six carbon atoms), lower alkynyl (i.e., two to six carbon atoms), benzyl, styryl, phenyl, biphenyl, naphthyl, alkoxy (e.g., methoxy, ethoxy, etc.), aryloxy (e.g., phenoxy), carboalkoxy (e.g., carbomethoxy, carboethoxy, etc.), carboaryloxy (e.g., carbophenoxy, carbonaphthoxy), acyloxy (e.g., acetoxy, benzoxy, etc.), acyl (e.g., acetyl, benzoyl, etc.), halogen (i.e., fluoride, chloride, bromide, iodide), cyanide, azide, nitro, haloalkyl (e.g., trifluoromethyl, trifluoroethyl, etc.), amino (e.g., dimethylamino), amido (e.g., acetamido, benzamido), ammonium (e.g., trimethylammonium), azo (e.g., phenylazo), sulfonyl (e.g., methylsulfonyl, phenylsulfonyl), sulfoxide (e.g., methylsulfoxide), sulfonium (e.g., dimethyl sulfonium), silane (e.g., trimethylsilane) and thioether (e.g., methyl mercaptide) substituents.

Hammett sigma values for the substituents of the tetrazole nucleus can be determined by reference to the published literature or can be determined directly using known determination procedures. Exemplary meta and para sigma values and procedures for their determination are set forth by H. VanBekkum, P. E. Verkade and B. M. Wepster in Rec. Trav. Chim, volume 78, page 815, published 1959; by P. R. Wells in Chem Revs., volume 63, page 171, published 1963, by H. H. Jaffe, Chem. Revs., volume 53, page 191, published 1953; by M. J. S. Dewar and P. J. Grisdale in J. Amer. Chem. Soc., volume 84, page 3548, published 1962; and by Barlin and Perrin in Quart. Revs., volume 20, page 75 et seq., published 1966.

In accordance with established practice, electron withdrawing (electronegative) substituents are assigned positive sigma values while electron donating (electropositive) substituents are assigned negative sigma values. Each tetrazole nucleus substituent is assigned a Hammett sigma value which is the algebraic sum of its substituted sigma value and the sigma value of its own substituents, if any. For example, unsubstituted phenyl tetrazole nucleus substituents have neutral sigma values, while the sigma values of substituted phenyl tetrazole nucleus substituents can be determined algebraically simply by determining from the literature the known Hammett sigma values for each substituent and obtaining the algebraic sum thereof. Other tetrazole nucleus substituents, particularly heterocyclic tetrazole nucleus substituents, can exhibit sigma values even when unsubstituted. For example, a 2-pyridyl substituent exhibits a sigma value of 0.56; a 3-pyridyl substituent exhibits a sigma value of 0.73; a 4-pyridyl substituent exhibits a sigma value of 0.83; a 2-thiazolyl substituent exhibits a sigma value of approximately 0.5; a 2-oxazolyl substituent exhibits a sigma value of 0.75. It is then apparent that a tetrazolium salt including an unsubstituted 4-pyridyl or 2-pyridyl substituent constitutes a preferred, stabilized dye producing tetrazolium salt, provided the remaining tetrazole nucleus substituents are on balance neutral or electronegative in their sigma values.

Sigma values for a given substituent are noted to vary as a function of ring position and resonance induced by conjugation. For example, a given substituent to a phenyl ring can exhibit one sigma value in the meta position and another when in the para position. A few substituents, such as nitro, dimethylamino and cyano substituents, for example, produce a conjugated system as para position substituents to 2 and 3 position phenyl rings and accordingly are assigned differing sigma values depending on the ring to which they are appended. For the purpose of assigning sigma values in accordance with the teachings of this process the sigma value for an ortho substituent is considered to be identical to the non-conjugated para position sigma value for that substituent. Certain illustrative Hammett sigma values for ring substituents of triphenyltetrazolium salts are as follows, Table II.

TABLE II

Exemplary Hammett Sigma Values For Triphenyltetrazolium Salt Substituents

| Substituent | meta | Ortho/para |
|---|---|---|
| $-N(CH_3)_2$ | +0.05 | +0.12[a] |
| $-t\text{-}C_4H_9$ | −0.07 | −0.14 |
| $-C_2H_5$ | −0.07 | −0.12 |
| $-CH_3$ | −0.07 | −0.13 |
| $-OCH_3$ | +0.08 | −0.17 |
| $-Si(CH_3)_3$ | −0.05 | +0.01 |
| $-H$ | ≡0.0 | ≡0.0 |
| $-C_6H_5$ | +0.06 | 0.0 |
| $-F$ | +0.34 | +0.08 |
| $-Cl$ | +0.37 | +0.25 |
| $-Br$ | +0.39 | +0.27 |
| $-I$ | +0.35 | +0.30 |
| $-CN$ | +0.62 | +0.65[b] |
| $-NO_2$ | +0.71 | +0.78[c] |
| $-C(O)CH_3$ | +0.38 | +0.50 |
| $-SO_2CH_3$ | +0.68 | +0.68 |
| $-N(CH_3)_3^+$ | +0.86 | +0.80 |
| $-CO_2CH_3$ | +0.32 | +0.39 |
| $-CHO$ | +0.38 | +1.00 |
| $-SCH_3$ | +0.22 | +0.22 |
| $-S(CH_3)_2^+$ | +1.0 | +1.2 |
| $-CF_3$ | +0.47 | +0.53 |

[a] −0.60 for 2 and 3 position phenyl rings as para substituent
[b] +0.75 for 2 and 3 position phenyl rings as para substituent
[c] +0.95 for 2 and 3 position phenyl rings as para substituent Exemplary tetrazolium cations having predominantly electronegative tetrazole nucleus substituents are as follows:

TABLE III

Exemplary Preferred Tetrazolium Cations for forming Dyes of Enhanced Stability

| | |
|---|---|
| T - 36 | 2-(4-methylthiophenyl)-3-(3,5-dichlorophenyl)-5-(3-nitrophenyl)-2H-tetrazolium |
| T - 37 | 2(4-cyanophenyl)-3-(3-benzamidophenyl)-5-(3,4-dichlorophenyl)-2H-tetrazolium |
| T - 38 | 2-(2-naphthyl)-3-(3-nitro-5-chlorophenyl)-5-(4-cyanophenyl)-2H-tetrazolium |
| T - 39 | 2-(4-bromo-1-naphthyl)-3-(4-cyanophenyl)-5-(3,4-dichlorophenyl)-2H-tetrazolium |
| T - 40 | 2-(3-pyridyl)-3-phenyl-5-(4-chlorophenyl)-2H-tetrazolium |
| T - 41 | 2-(2,4-dichlorophenyl)-3-(4-nitrophenyl)-5-phenyl-2H-tetrazolium |
| T - 42 | 2-(2,4,5-trichlorophenyl)-3-(4-nitrophenyl)-5-phenyl-2H-tetrazolium |
| T - 43 | 2-(2,4,5-trichlorophenyl)-3-(4-phenylsulfonyl phenyl)-5-phenyl-2H-tetrazolium |
| T - 44 | 2-(2,3,4,5-tetrachlorophenyl)-3-(4-nitrophenyl)-5-phenyl-2H-tetrazolium |
| T - 45 | 2-(2-trifluoromethyl-5-chlorophenyl)-3-(4-cyanophenyl)-5-phenyl-2H-tetrazolium |
| T - 46 | 2-(4-pyridyl)-3-(2-trifluoromethylphenyl)-5-phenyl-2H-tetrazolium |
| T - 47 | 2-(2-chloro-5-trifluoromethylphenyl)-3-(3,4-dichlorophenyl)-5-phenyl-2H-tetrazolium |
| T - 48 | 2-(2-chloro-5-nitrophenyl)-3-(4-acetyl phenyl)-5-(3-nitrophenyl)-2H-tetrazolium |
| T - 49 | 2-(2-chloro-4-cyanophenyl)-3-(4-benzoylphenyl)-5-(3-chlorophenyl)-2H-tetrazolium |
| T - 50 | 2-(2-nitro-4-chlorophenyl)-3-(4-phenylazophenyl)-5-(4-chlorophenyl)-2H-tetrazolium |
| T - 51 | 2-[4-(4-nitrophenyl)thiophenyl]-3-(2-chloro-5-trifluoromethylphenyl)-5-(3-nitrophenyl)-2H-tetrazolium |
| T - 52 | 2-(4-phenylsulfonylphenyl)-3-(2-chloro-5-trifluoromethyl phenyl)-5-(3,4-dichlorophenyl)-2H-tetrazolium |
| T - 53 | 2-(4-benzylphenyl)-3-(2,4-dichlorophenyl)-5-(4-nitrophenyl)-2H-tetrazolium |
| T - 54 | 2-(4-phenylsulfonylphenyl)-3-(2-chloro-4-cyanophenyl)-5-(3,4-dichlorophenyl)-2H-tetrazolium |
| T - 55 | 2-(2-methoxy-4-nitrophenyl)-3-(4-cyanophenyl)-5-phenyl-2H-tetrazolium |
| T - 56 | 2-(3-propionylphenyl)-3-(2,4-dichlorophenyl)-5-(3-nitrophenyl)-2H-tetrazolium |
| T - 57 | 2-(2-biphenyl)-3-(3,4-dichlorophenyl)-5- |

TABLE III-continued

| Exemplary Preferred Tetrazolium Cations for forming Dyes of Enhanced Stability | |
|---|---|
| | (4-cyanophenyl)-2H-tetrazolium |
| T - 58 | 2-(4-nitrophenyl)-3-(3-pyridyl)-5-phenyl-2H-tetrazolium |
| T - 59 | 2-(2-chloro-4-cyanophenyl)-3-(2-chloro-5-trifluoromethylphenyl)-5-(3-chlorophenyl)-2H-tetrazolium |
| T - 60 | 2-(4-pyridyl)-3-(2,3,4,5-tetrafluorophenyl)-5-phenyl-2H-tetrazolium |
| T - 61 | 2-(2-benzoylphenyl)-3-(2,4-dichlorophenyl)-5-(3-nitrophenyl)-2H-tetrazolium |
| T - 62 | 2-(1-nitro-2-naphthyl)-3-(2-methyl-4-nitrophenyl)-5-(4-chlorophenyl)-2H-tetrazolium |
| T - 63 | 2-(3-phenylformamidophenyl)-3-(2-nitro-4-chlorophenyl)-5-(3-chlorophenyl)-2H-tetrazolium |
| T - 64 | 2-(anthraquinone-2-yl)-3-(2-nitro-4-chlorophenyl)-5-(4-cyanophenyl)-2H-tetrazolium |
| T - 65 | 2-(2,5-dichlorophenyl)-3-phenyl-5-(4-nitrophenyl)-2H-tetrazolium |
| T - 66 | 2-(2,4-dibromophenyl)-3-(4-nitrophenyl)-5-methyl-2H-tetrazolium |
| T - 67 | 2-(2,5-dichlorophenyl)-3-(2-methoxy-4-nitrophenyl)-5-(4-methoxyphenyl)-2H-tetrazolium |
| T - 68 | 2-(2,4,5-trichlorophenyl)-3-(3-nitrophenyl)-5-ethyl-2H-tetrazolium |
| T - 69 | 2-(4-trifluoromethylphenyl)-3-(4-cyanophenyl)-5-n-propyl-2H-tetrazolium |
| T - 70 | 2-(2-phenoxy-4-chlorophenyl)-3-(4-nitrophenyl)-5-n-hexyl-2H-tetrazolium |
| T - 71 | 2-(2-bromophenyl)-3-(2-nitrophenyl)-5-phenyl-2H-tetrazolium |
| T - 72 | 2,3-di(4-nitrophenyl)-5-methyl-2H-tetrazolium |
| T - 73 | 2-(4-bromophenyl)-3-(4-nitrophenyl)-5-tert-butyl-2H-tetrazolium |
| T - 74 | 2-(4-iodophenyl)-3-(4-nitrophenyl)-5-phenyl-2H-tetrazolium |
| T - 75 | 2-(2-nitro-1-naphthyl)-3-(4-cyanophenyl)-5-methyl-2H-tetrazolium |
| T - 76 | 2-(2-nitro-4-chloro-1-naphthyl)-3-(4-trifluoromethylphenyl)-5-methyl-2H-tetrazolium |
| T - 77 | 2-(2-bromo-4-cyano-1-naphthyl)-3-(4-nitrophenyl)-5-n-propyl-2H-tetrazolium |
| T - 78 | 2-(1-bromo-4-nitro-2-naphthyl)-3-(3,4-dichlorophenyl)-5-ethyl-2H-tetrazolium |
| T - 79 | 2-(3,6,7-trichloro-1-naphthyl)-3-(4-nitrophenyl)-5-n-hexyl-2H-tetrazolium |
| T - 80 | 2-(5-nitro-2-naphthyl)-3-(2,4,5-trichlorophenyl)-5-isobutyl-2H-tetrazolium |
| T - 81 | 2-(5,8-dichloro-1-naphthyl)-3-(4-nitrophenyl)-5-methyl-2H-tetrazolium |
| T - 82 | 2-(3,5-dibromo-2-naphthyl)-3-(4-chlorophenyl)-5-propyl-2H-tetrazolium |
| T - 83 | 2,3-di(2-chlorophenyl)-5-phenyl-2H-tetrazolium |
| T - 84 | 2-(2-nitrophenyl)-3,5-diphenyl-2H-tetrazolium |
| T - 85 | 2-(2-chloro-4-nitrophenyl)-3,5-diphenyl-2H-tetrazolium |
| T - 86 | 2-(2-chlorophenyl)-3-phenyl-5-(3-nitrophenyl)-2H-tetrazolium |
| T - 87 | 2-(2,4-dinitrophenyl)-3,5-diphenyl-2H-tetrazolium |
| T - 88 | 2,3,5-tri(4-nitrophenyl)-2H-tetrazolium |
| T - 89 | 2-(2-methyl-4-nitrophenyl)-3,5-diphenyl-2H-tetrazolium |
| T - 90 | 2-(4-nitrophenyl)-3,5-diphenyl-2H-tetrazolium |
| T - 91 | 2-(4-iodophenyl)-3-(4-nitrophenyl)-5-phenyl-2H-tetrazolium |
| T - 92 | 2-(4-nitrophenyl)-3-phenyl-5-(4-chlorophenyl)-2H-tetrazolium |
| T - 93 | 2,3-di(4-nitrophenyl)-5-phenyl-2H-tetrazolium |
| T - 94 | 2,5-di(4-nitrophenyl)-3-phenyl-2H-tetrazolium |
| T - 95 | 2,3-di(4-nitrophenyl)-5-(4-methoxyphenyl)-2H-tetrazolium |
| T - 96 | 2-(3-chlorophenyl)-3-(4-cyanophenyl)-5-(3,4-dichlorophenyl)-2H-tetrazolium |
| T - 97 | 2-(4-phenylsulfonyl phenyl)-3-(3,5-dichlorophenyl)-5-(4-cyanophenyl)-2H-tetrazolium |
| T - 98 | 2-(4-diphenyl)-3-(3,5-dinitrophenyl)-5-(4-trimethylammonium phenyl)-2H-tetrazolium |
| T - 99 | 2-(4-acetylphenyl)-3-(3-trifluoromethyl-4-chlorophenyl)-5-(4-nitrophenyl)-2H-tetrazolium |

While distinct stabilization is observed for bidentate and tridentate formazan dye chelates, the use of tetrazolium cations that form tridentate or tetradentate chelates gives greater stabilization and an affinity for a greater number of metals in subsequent processing discussed below. Exemplary of tetrazolium cations capable of forming tridentate formazan dye chelates are disclosed in U.S. Patent application Serial No. 384,858, cited above. Of particular usefulness are those having one or more N-heterocyclic aromatic rings in the 2 or 3 position, such as 2-pyridyl and 2-azolyl (e.g., 2-thiazolyl, 2-benzothiazolyl, 2-oxazolyl, 2-benzoxazolyl, etc.) ring structures, for example. Certain exemplary preferred tetrazolium cations for forming highly stable tridentate formazan dye chelates are as follows:

TABLE IV

| Exemplary Preferred Tetrazolium Cations for Forming Tridentate or Tetradentate Formazan Dye Chelates | |
|---|---|
| T - 100 | 2-(2-pyridyl)-3-(2,6-dimethylphenyl)-5-phenyl-2H-tetrazolium |
| T - 101 | 2-(2-pyridyl)-3-phenyl-5-n-hexyl-2H-tetrazolium |
| T - 102 | 2-(2-pyridyl)-3,5-diphenyl-2H-tetrazolium |
| T - 103 | 2-(benzothiazol-2-yl)-3,5-diphenyl-2H-tetrazolium |
| T - 104 | 2-(2-pyridyl)-3-(4-chlorphenyl)-5-phenyl-2H-tetrazolium |
| T - 105 | 2,2'-di(thiazol-2-yl)-3,3'-diphenyl-5,5'-diphenylene-di(2H-tetrazolium |
| T - 106 | 2,3-di(benzothiazol-2-yl)-5-dodecyl-2H-tetrazolium |
| T - 107 | 2-phenyl-3-(benzothiazol-2-yl)-5-(3-chlorophenyl)-2H-tetrazolium |
| T - 108 | 2,3-di(benzothiazol-2-yl)-5-cyano-2H-tetrazolium |
| T - 109 | 2-phenyl-3-(benzothiazol-2-yl)-5-propyl-2H-tetrazolium |
| T - 110 | 3-(4,5-dimethylthiazol-2-yl)-2,5-diphenyl-2H-tetrazolium |
| T - 111 | 2-(2-quinolinyl)-3-phenyl-5-(3-nitrophenyl)-2H-tetrazolium |
| T - 112 | 2-(2-pyridyl)-3-(2-tolyl)-5-(4-cyanophenyl)-2H-tetrazolium |
| T - 113 | 1,5-naphthalene-bis[3-[2-(2-pyridyl)-5-(3,4-dichlorophenyl)-2H-tetrazolium |
| T - 114 | 2-(2-pyridyl)-3-(4-nitrophenyl)-5-phenyl-2H-tetrazolium |
| T - 115 | 2-(benzothiazol-2-yl)-3,5-di(4-chlorophenyl)-2H-tetrazolium |
| T - 116 | 2-(benzothiazol-2-yl)-3-(3-nitrophenyl)-5-(4-iodophenyl)-2H-tetrazolium |
| T - 117 | 2-(benzothiazol-2-yl)-3-(2-fluorophenyl)-5-(4-cyanophenyl)-2H-tetrazolium |
| T - 118 | 2-(4,5-dimethylthiazol-2-yl)-3-(3-trifluoromethylphenyl)-5-(4-bromophenyl)-2H-tetrazolium |
| T - 119 | 2-(benzoxazol-2-yl)-3-(4-chlorophenyl)-5-phenyl-2H-tetrazolium |
| T - 120 | 2-(2-pyridyl)-3-(2-hydroxyphenyl)-5-phenyl-2H-tetrazolium |
| T - 121 | 2-[2-(8-hydroxyquinolyl)]-3,5-diphenyl-2H-tetrazolium |

The element of the invention preferably is formed by coating the above-defined tetrazolium salt upon a support using any conventional coating technique. Any conventional photographic support can be utilized in the practice of this invention. Typical supports include transparent supports, such as film supports and glass supports as well as opaque supports, such as metal and photographic paper supports. The support can be either rigid or flexible. The most common photographic supports for most applications are paper or film supports, such as poly(ethylene terephthalate) film. The support can incorporate one or more subbing layers for the purpose of altering its surface properties so as to enhance the adherency of the radiation-sensitive coating to the support. A typical example of a suitable subbing material is the ter-polymer or vinylidene chloride, acrylonitrile, and vinyl chloride. Suitable exemplary supports are disclosed in *Product Licensing Index*, Vo. 92, December 1971, Publication 9232, at page 108.

The coating of the salt may be made directly on the support, or it may be a dispersion in a suitable binder, such as gelatin or cellulose acetate butyrate. The anion and cation of the tetrazolium salt may be introduced into the layer either as a single compound, or they may be separately introduced as a tetrazolium salt of another anion, such as a halide, and a metallic salt of the reducing anion, such as the sodium salt or the potassium salt of the reducing anion. In the latter case, the tetrazolium cation and reducing anion are believed to form a salt in situ.

The coating can be achieved by dissolving the reactants, the binder and any other desired addenda in a solvent system and coating the solution onto the support by such means as whirler coating, brushing, doctor blade coating, hopper coating and the like. Thereafter the solvent is evaporated. Other exemplary coating procedures are set forth in the *Product Licensing Index* publication cited above, at page 109. Coating aids can be incorporated into the coating composition to facilitate coating as disclosed on page 108 of the *Product Licensing Index* publication. It is also possible to incorporate antistatic layers and/or matting agents as disclosed on page 108 of the *Product Licensing Index* publication.

The solvent system can be a common solvent or a combination of miscible solvents which together bring all of the reactants into solution. Typical preferred solvents which can be used alone or in combination are water; lower alkanols, such as methanol, ethanol, isopropanol, t-butanol and the like, and ethylene chloride.

Imaging is thus achieved by exposure of the element formed as described above, to radiation having wavelengths in excess of 300 nm. The element immediately forms a visible image without further processing. While it is not intended that the invention be limited to a particularly theory of operation, it is believed that the chemistry of the reduction proceeds generally as follows:

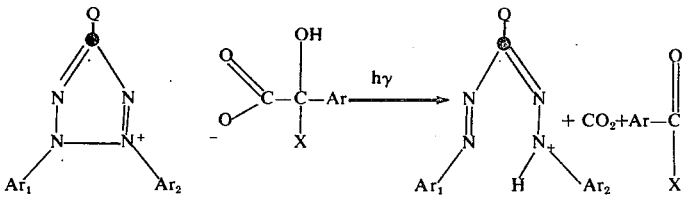

where Ar is the aromatic radical as defined above, X is defined as above, $Ar_1$ and $Ar_2$ are aromatic groups characteristic of the particular tetrazolium salt and Q is either hydrogen, Ar or alkyl, typically having from 1 to 20 carbon atoms.

STABILIZATION

Although certain of the above-identified tetrazolium salts produce formazan dyes having considerable stability, further stability can be achieved by chelating the formazan dye. All formazan dyes are capable of forming at least bidentate chelates. The British Pat. No. 1,016,822 noted above, suggests the use of salts of iron, nickel, cobalt, copper, zinc, cadmium, chromium, titanium, molybdenum or tungsten, for this purpose. It is recognized that such metal salts can be used also in the practice of this invention, for the purpose of chelating the formazan dye produced on exposure, thereby stabilizing the dye. Metal ions particularly useful with tridentate-complexing formazan dyes described above include cobalt, copper, nickel, cadmium, and zinc. Most suitable anions are weakly complexing inorganic anions such as $NO_3^-$, $ClO_4^-$, $BF_4^-$ and $PF_6^-$ and organic anions such as cyclohexylbutyrate, tosylate, ethyl aceto acetate, acetylacetonate, and the like.

It has been further discovered that the selection of an anion for the metal ion used in the chelating step will produce a salt that is also suitable for stabilizing e.g., fixing unexposed tetrazolium salt. To achieve this result simultaneously with the stabilization of the image dye, the salt should be selected such that a. The metal ion forms a more stable hydroxycarboxylate salt than does the tetrazolium cation. Most metal ions are adequate since the tetrazolium cation is only weakly polarizing.

b. The anion associated with the metal ion forms a less stable salt with the metal ion than does the hydroxycarboxylate ion. Most suitable are weakly complexing, inorganic anions such as $NO_3^-$, $ClO_4^-$, $BF_4^-$ and $PF_6^-$ and organic anions such as cyclohexylbutyrate, tosylate, and the like.

c. The metal ion does not reduce the tetrazolium salt.

d. The metal ion preferably forms a stable complex with the resulting formazan dye to give the colorshift and stabilization effects.

e. The metal salt in a suitable solvent efficiently permeates the binder, if the element is subsequently processed in a fixing bath. Such a suitable solvent depends upon the nature of the salt's anion and can be selected from polar solvents including water. Alternatively the metal complex can be coated with a binder as a separate layer which is contiguous with the tetrazolium containing layer. In the precoated case, intermixing and therefore fixing can be achieved by slightly melting the two layers after exposure.

Alternatively, tetrazolium stabilization can be achieved by conventional wash steps either subsequent to or prior to the dye stabilization step, wherein the tetrazolium salt is simply washed out of the element.

The surface or areal densities of the ingredients of the coating can vary as a function of the formazan dyes formed and the image densities desired. It is generally preferred to incorporate the tetrazolium salt in a concentration of at least $1 \times 10^{-6}$ moles per square decimeter and, most preferably, in a concentration of from $1 \times 10^{-5}$ to $4 \times 10^{-5}$ moles per square decimeter. If the metal salt used to stabilize the element is also preincorporated in the element, the areal density of the fixing complex is, of course, roughly stoichiometric. However, either of the salts may be present in excess. The binder can account for up to 99% by weight of the radiation-sensitive layer, but is typically employed in proportions of from 50 to 90% by weight of the radiation-sensitive layer. Typically the radiation-sensitive layer can vary widely in thickness depending on the characteristics desired for the photographic element—e.g., image density, flexilibity, transparency, etc. For most photographic applications coating thicknesses in the range of from 2 microns to 20 microns are preferred.

EXAMPLES

The invention is further demonstrated by the following examples, which are non-exhaustive illustrations only, rather than a representation that none others are permissible.

EXAMPLE 1

To make a tetrazolium mandelate as the photosensitive compound, a solution of 1.90 gms. of potassium mandelate in 7 ml of acetonitrile and 3 ml water was added to a solution of 5.06 gms. of 2-(p-iodiphenyl)-3-(p-nitrophenyl)-5-phenyl-2H-tetrazolium chloride in 100 ml of the same solvent mixture. The solvent was removed on a flash evaporator and the tetrazolium mandelate was dissolved in acetone. The acetone was removed on the evaporator yielding 5.9 gms of a pale brown solid which was used without further purification. This solid will be referred to as INT mandelate.

A solution of 0.366 gms INT mandelate and 6.75 gms 2-methoxyethanol plus 2.25 gms 10 percent cellulose acetate-butyrate in acetone was coated 100 microns thick on subbed poly(ethylene terephthalate) film support.

The dry coating was imagewise exposed for 30 seconds on a "Filmsort Uniprinter" copier manufactured by 3M Company. A red negative image was produced with $D_G$max = 2.0 and $D_G$min = 0.05, where $D_G$ max (or min) represent the maximum (or minimum) green density.

A fixing solution of 2.4 gms $Cu(NO_3)_2 \cdot 3H_2O$; 15 ml n-propanol; 85 ml $H_2O$ was heated to 50°C. The exposed coating was dipped into this bath for 10 seconds and wiped dry. The image was noticeably more magenta in color ($D_G$max = 2.1 and $D_G$min = 0.05).

The image was given a second 30 second overall exposure on the "Filmsort Uniprinter" after which the $D_G$ max = 1.95 and the $D_G$ min = 0.12. Such a negligible increase in $D_{green\ min}$ established that the fixing process did in fact stabilize the unexposed tetrazolium salt.

EXAMPLES 2–5

Solutions for Examples 2–10 were prepared according to the following Formulation I.

| Formulation I | |
|---|---|
| 2,3,5-triphenyl-2H-tetrazolium cation | 1.00 mmole |
| Benzilate anion | 1.00 mmole |
| Cellulose acetate-butyrate | 0.66 g |
| Ethylene chloride | 9.0 ml |
| Methanol | 2.5 ml |

In addition, the layers for Example 3 through Example 5 included a metal salt in an amount of about 1.0 mmole, the particular salt being that shown in Table V. The solutions were coated by means of a doctor blade at 100 microns wet thickness on subbed poly(ethylene terephthalate) film support and air dried. Imaging was accomplished by contact exposure for eight seconds through a silver step tablet to the mercury arc light source in a commercial diazo processor sold under the trade name IBM Copier IID. The color shift for Examples 3–5, as in the case of subsequent examples, established that chelation and therefore dye stabilization had been obtained.

TABLE V

| Example | Metal Salt | Results Image Color | Background Color |
|---|---|---|---|
| 2 | none | Red ($D_G^{max}$ = 0.94) | colorless |
| 3 | Co(Cyclohexylbutyrate)$_2$ | Magenta ($D_G^{max}$ = 0.70) | colorless |
| 4 | Cu(Cyclohexylbutyrate)$_2$ | Purple ($D_G^{max}$ = 0.23) | faint green |
| 5 | Cu(Ethyl acetylacetate)$_2$ | Blue ($D_G^{max}$ = 0.38) | colorless |

The results of Example 5 are of particular interest as a blue formazan dye is thus produced without a yellow background.

EXAMPLE 6

The coating was prepared using the above Formulation I, except that the tetrazolium salt was 2-(p-iodophenyl)-3-(p-nitrophenyl)-5-phenyl-2H-tetrazolium benzilate. Exposure as in Example 2 produced a red negative image ($D_G^{max}$ = 1.60) on a colorless background.

EXAMPLES 7–9

Coatings were prepared as in Example 6, but additionally the layer contained a metal salt in an amount of about 1 mmole. The photographic results are summarized in Table VI.

TABLE VI

| Example | Metal Salt | Image Color | Background Color |
|---|---|---|---|
| 7 | Co(Cyclohexylbutyrate)$_2$ | Purple ($D_G$ = 1.0) | faint purple |
| 8 | Cu(Cyclohexylbutyrate)$_2$ | Cyan ($D_R$ = 0.68) | pale blue |

TABLE VI-continued

| Example | Metal Salt | Image Color | Background Color |
|---|---|---|---|
| 9 | Cu(Ethyl acetylacetate)$_2$ | Green ($D_R = 0.66$) | yellow |

EXAMPLE 10

The coating was prepared as in Example 1, except that 2-(4,5-dimethyl-2-thiazolyl)-3,5-diphenyl-2H-tetrazolium benzilate was substituted as the tetrazolium salt. Exposure as in Example 2 of the coating produced a purple negative image ($D_G^{max} = 2.1$) on a yellow background ($D_G^{min} = 0.14$).

EXAMPLES 11–16

Coatings were prepared as in Example 10, but additionally containing in the layer a metal salt in an amount of about 1 mmole. Exposures by the procedure of Example 2 produced the photographic results summarized in Table VII.

TABLE VII

| Example | Metal Salt | Image Color | Background Color |
|---|---|---|---|
| 11 | Co(Cyclohexylbutyrate)$_2$ | Blue | light blue |
| 12 | Ni(Cyclohexylbutyrate)$_2$ | Cyan | green |
| 13 | Ni(Acetylacetonate)$_2$ | Cyan | green |
| 14 | Cu(Cyclohexylbutyrate)$_2$ | Cyan | green |
| 15 | Zn(Cyclohexylbutyrate)$_2$ | Cyan | light cyan |
| 16 | Cd(Cyclohexylbutyrate)$_2$ | Cyan | light cyan |

EXAMPLES 17–19

In these examples, the tetrazolium salt was formed in situ by adding to Formulation I while in solution, equal molar amounts of the tetrazolium salt identified in Table VIII, and sodium benzilate, the total quantity being that sufficient to produce 1 mmole of the photosensitive tetrazolium benzilate salt. Exposure as in the previous Example 2 produced the results of Table VIII.

TABLE VIII

| Example | Tetrazolium Cation Source | Image Color | Background Color |
|---|---|---|---|
| 17 | 2,3,5-triphenyl-2H-tetrazolium chloride | red ($D_G^{max} = 0.92$) | colorless |
| 18 | 2-[p-nitrophenyl-3-(p-iodiphenyl)]-5-phenyl-2H-tetrazolium chloride | red ($D_G^{max} = 1.74$) | colorless |
| 19 | 2-(4,5-dimethyl-2-thiazolyl)-3,5-diphenyl-2H-tetrazolium bromide | purple ($D_G^{max} = 1.2$) | yellow |

The invention has been described in detail with particular reference to preferred embodiments thereof, but it will be understood that variations and modifications can be effected within the spirit and scope of the invention.

What is claimed is:

1. A photosensitive element comprising

A. a support, and

B. at least one layer coated over the support, said layer comprising a salt of a tetrazolium cation and an anion capable of reducing said cation to a formazan dye upon activating radiation, said anion having the formula

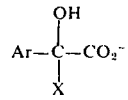

wherein Ar is an aromatic but not a heterocyclic radical containing from 6 to 10 carbon atoms, and X is either Ar or hydrogen.

2. A photosensitive element comprising

A. a support, and

B. at least one layer coated over the support, said layer comprising a salt of a tetrazolium cation and an anion capable of reducing said cation to a formazan dye upon exposure to activating radiation, said anion having the formula

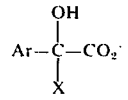

wherein Ar is phenyl or naphthyl, and

X is either Ar or hydrogen.

3. The element as defined in claim 1 and further including a metallic complex in said element comprising a metal ion capable of forming a chelate with said formazan dye, and an anion which forms a less stable complex with said metal ion than does said formazan dye, said anion being selected from the group consisting of cyclohexylbutyrate and ethyl acetylacetate.

4. The element as defined in claim 1 and further including in a layer separate from but contiguous with said one layer, a metallic complex in said element comprising a metal ion having a greater affinity for said reducing anion than does said tetrazolium cation, and an anion which forms a less stable complex with said metal ion than does said reducing anion, said anion being selected from the group consisting of $NO_3^-$, $ClO_4^-$, $BF_4^-$, and $PF_6^-$;

whereby the unexposed tetrazolium is stabilized.

5. The element as defined in claim 3 wherein said metallic complex is coated, along with a binder, in a separate layer contiguous with said one layer.

6. The element as defined in claim 1, wherein said tetrazolium cation is capable of forming a tridentate formazan dye chelate.

7. The element as defined in claim 6, in which said tetrazolium cation contains at least one 2-pyridyl or 2-azolyl tetrazole nucleus substituent in the 2 or 3 position.

8. The element as defined in claim 1, further characterized in that it is essentially free of additional photoactivated reducing agents capable of reducing said tetrazolium cation.

9. The element as defined in claim 3 wherein said tetrazolium cation is capable of forming a tridentate formazan dye chelate.

10. The element as defined in claim 9 wherein said metal ion is selected from the group consisting of cobalt, nickel, copper, zinc and cadmium.

11. The element as defined in claim 1, and further including a metallic complex in said element comprising a metal ion capable of forming a chelate with said formazan dye and having a greater affinity for said reducing anion than does said tetrazolium cation, and an anion which forms a less stable complex with said metal ion than does said formazan dye.

12. An image recording process comprising imagewise exposing an element including a support, and at least one layer coated over the support, said layer comprising a photosensitive salt of a tetrazolium cation and an anion having the formula

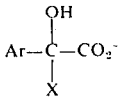

wherein

Ar is phenyl or naphthyl, and

X is either Ar or hydrogen, and stabilizing the exposed element by incorporating in the element a salt comprising a metal ion capable of forming a chelate with said formazan dye and an anion selected from the group consisting of $NO_3^-$, $ClO_4^-$, $BF_4^-$, $PF_6^-$, and organic anions, whereby upon exposure and formation of a formazan dye, the metal ion forms a chelate with the dye.

13. The process as defined in claim 12 and further including the step of fixing tetrazolium salt in the element against print-out by combining remaining reducing anion with said metal ion remaining from said stabilizing step.

14. The process as defined in claim 13 wherein said stabilizing and said fixing steps comprise the step of subjecting the element to a fixing bath comprising a solvent, said metal ion and said selected anion.

* * * * *

UNITED STATES PATENT AND TRADEMARK OFFICE

CERTIFICATE OF CORRECTION

PATENT NO. : 3,957,514

DATED : May 18, 1976

INVENTOR(S) : Anthony Adin

It is certified that error appears in the above-identified patent and that said Letters Patent are hereby corrected as shown below:

Column 1, line 18, "No. 670,833" should read --No. 670,883--.

Colum 2, line 65 (formula)

" 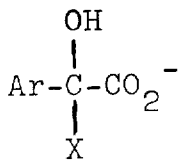 "

should read

-- 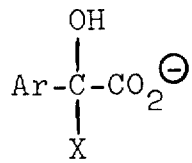 --

UNITED STATES PATENT AND TRADEMARK OFFICE

CERTIFICATE OF CORRECTION

PATENT NO. : 3,957,514

DATED : May 18, 1976

INVENTOR(S) : Anthony Adin

It is certified that error appears in the above-identified patent and that said Letters Patent are hereby corrected as shown below:

Column 9, (formula)

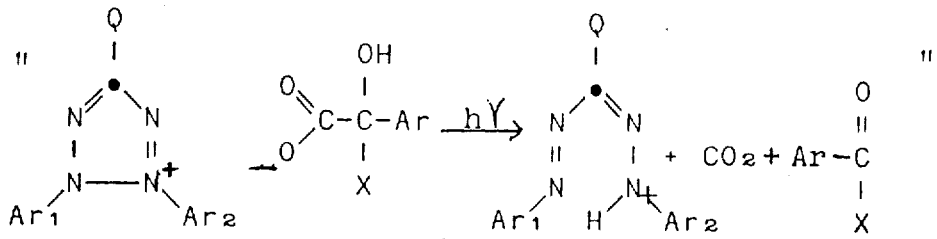

should read

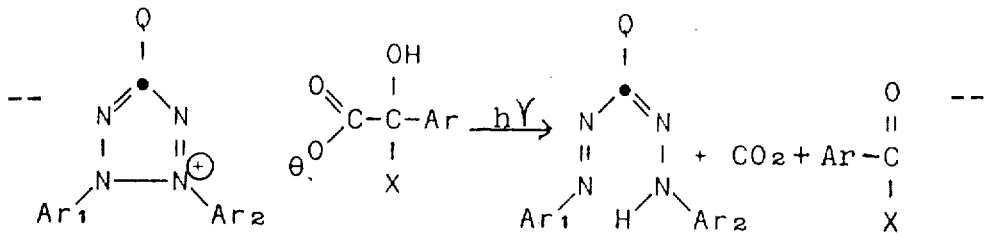

UNITED STATES PATENT AND TRADEMARK OFFICE

CERTIFICATE OF CORRECTION

PATENT NO. : 3,957,514
DATED : May 18, 1976
INVENTOR(S) : Anthony Adin

It is certified that error appears in the above-identified patent and that said Letters Patent are hereby corrected as shown below:

Column 14, line 10 (formula)

" 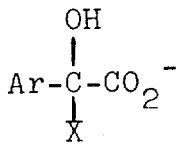 "

should read

-- 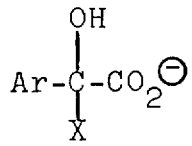 --

Column 14, line 35 (formula)

" 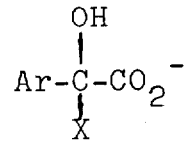 "

should read

UNITED STATES PATENT AND TRADEMARK OFFICE

CERTIFICATE OF CORRECTION

PATENT NO. : 3,957,514

DATED : May 18, 1976

INVENTOR(S) : Anthony Adin

It is certified that error appears in the above-identified patent and that said Letters Patent are hereby corrected as shown below:

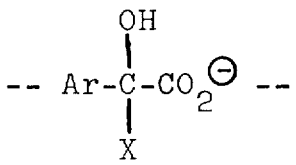

Column 16, line 10 (formula)

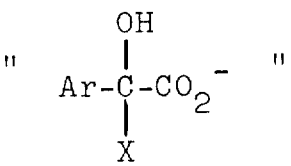

should read

UNITED STATES PATENT AND TRADEMARK OFFICE

CERTIFICATE OF CORRECTION

PATENT NO. :3,957,514

DATED :May 18, 1976

INVENTOR(S) :Anthony Adin

It is certified that error appears in the above-identified patent and that said Letters Patent are hereby corrected as shown below:

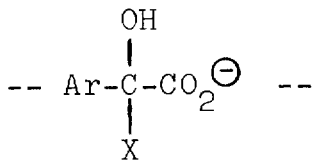

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*